US005970963A

United States Patent [19]

Nakase et al.

[11] Patent Number: 5,970,963

[45] Date of Patent: Oct. 26, 1999

[54] APPARATUS FOR PREVENTING FLOW NOISE IN THROTTLE VALVE

[75] Inventors: Yoshihiro Nakase; Kouzi Ohara; Tokio Kohama; Kenji Kanehara, all of Nishio; Kenichi Yamamoto, Okazaki; Yoshihiro Miyaji, Toyota, all of Japan

[73] Assignees: Nippon Soken, Inc., Nishio; Toyota Jidosha Kabushiki Kaisha, Toyota, both of Japan

[21] Appl. No.: 09/034,363

[22] Filed: Mar. 4, 1998

[30] Foreign Application Priority Data

| | | | |
|---|---|---|---|
| Mar. 4, 1997 | [JP] | Japan | 9-048741 |
| Jun. 27, 1997 | [JP] | Japan | 9-171878 |
| Nov. 10, 1997 | [JP] | Japan | 9-307035 |

[51] Int. Cl.[6] ..... F02M 29/04

[52] U.S. Cl. ..... 123/590; 123/184.21

[58] Field of Search ..... 123/590, 184.21, 123/545, 184.53; 251/127, 305; 239/502, 500, 522, 471, 461, 462

[56] References Cited

U.S. PATENT DOCUMENTS

| | | | |
|---|---|---|---|
| 1,099,271 | 6/1914 | Sykora | 123/545 |
| 3,467,072 | 9/1969 | Toesca | 123/590 |
| 3,826,235 | 7/1974 | Pasbrig | 123/590 |
| 3,998,195 | 12/1976 | Scott . | |
| 4,300,494 | 11/1981 | Graiff et al. | 123/193.5 |
| 4,333,441 | 6/1982 | Still et al. . | |
| 4,452,219 | 6/1984 | Tay-Lodge et al. | 123/590 |
| 4,532,909 | 8/1985 | Jackson | 123/590 |
| 4,667,648 | 5/1987 | Beldin . | |
| 4,672,940 | 6/1987 | Nakayama et al. | 123/590 |
| 4,718,393 | 1/1988 | Bakish | 123/545 |
| 5,722,357 | 3/1998 | Choi | 123/184.21 |
| 5,730,213 | 3/1998 | Kiser et al. | 165/148 |
| 5,758,614 | 6/1998 | Choi | 123/590 |

FOREIGN PATENT DOCUMENTS

| | | | |
|---|---|---|---|
| 0 180 914 | 5/1986 | European Pat. Off. . | |
| 0 188 130 | 7/1986 | European Pat. Off. . | |
| 852694 | 3/1940 | France . | |
| 1344121 | 2/1964 | France . | |
| 2 264 983 | 10/1975 | France . | |
| 27 43 000 | 12/1978 | Germany . | |
| 32 26 453 | 1/1984 | Germany . | |
| 47706 | 6/1977 | Japan | 123/590 |
| 55-35177 | 3/1980 | Japan . | |
| 57-107838 | 7/1982 | Japan . | |
| 62-288318 | 12/1987 | Japan . | |
| 1-318756 | 12/1989 | Japan . | |
| 2-119963 | 9/1990 | Japan . | |
| 8-128367 | 5/1996 | Japan . | |
| 366147 | 2/1932 | United Kingdom | 123/590 |
| 1 419 303 | 12/1975 | United Kingdom . | |
| 97/23742 | 7/1997 | WIPO . | |

OTHER PUBLICATIONS

I P C F0 2M, Toyota Motor Corporation pp. 97–100.

*Primary Examiner*—Noah P. Kamen
*Assistant Examiner*—Jason Benton
*Attorney, Agent, or Firm*—Pillsbury Madison & Sutro LLP

[57] ABSTRACT

An apparatus for preventing flow noise which suppresses the noise caused at the time of opening of a throttle valve provided in an intake passage of an internal combustion engine etc. At the downstream side of a pair of clearances formed at the top and bottom when the throttle valve opens, a means is provided acting on the flows of air passing through at least one of the clearances to reduce the flow rate and acting on the flows to cause the point of convergence of the flows of air passing through the pair of clearances to shift to the downstream side.

26 Claims, 14 Drawing Sheets

APPARATUS FOR PREVENTING FLOW NOISE IN THROTTLE VALVE

BACKGROUND OF THE INVENTION

1. Field of the Invention

The present invention relates to an apparatus for the suppression of the flow noise caused by a throttle valve provided in an intake passage or exhaust passage of an internal combustion engine.

2. Description of the Related Art

In recent years, steps have been taken to prevent the generation of noise from parts of automobiles with a high noise level with the objective of increasing the quietness of the passenger compartment of the automobiles. As the effects of these steps have taken hold, relatively low level noise, which had not been considered a problem in the past, has begun to be treated as problematic. One type of noise audible in the passenger compartment is the noise generated when a throttle valve is opened. This consists of the high frequency flow noise generated from the intake system when the throttle valve provided in the intake passage is made to rapidly open from the fully closed state. This noise is particularly noticeable in recent engines with intake manifolds fabricated out of plastic.

Similar flow noise is generated in the exhaust system of a vehicle having a throttle valve in the exhaust passage as well when causing the throttle valve to rapidly open. This noise also is particularly noticeable in recent engines with exhaust manifolds fabricated from pressed sheet metal. Accordingly, development of a means for suppressing the flow noise generated along with the operation of these throttle valve is becoming urgently required.

One related art being experimented with as a means of suppressing flow noise is illustrated in FIG. 1 and FIG. 2. This was disclosed in Japanese Unexamined Utility Model Publication (Kokai) No. 57-107838 and was aimed at the prevention of backfires. In this art, a metal net 4 was stretched across an air passage 2 inside a throttle body 1 at the downstream side of an ordinary throttle valve 3 provided so as to open and close the air passage 2 (arrow mark shows direction of flow of air). The object of this is to use the metal net 4 to suppress fluctuations in pressure at the downstream side of the throttle valve 3 and thereby try to prevent the generation of noise. This measure, however, has the problem of reducing the engine output somewhat due to the pressure loss of the flow of air.

As another related art, consideration may be given to the method of attaching a noise suppressing cover 5 at the outside of the throttle valve 1 or intake manifold to seal the noise inside the noise suppressing cover. This method is effective in preventing the diffusion of flow noise, but not only is the cost higher, but the weight increases as well. Further, the throttle body 1 and the intake manifold etc. connected to the same become bulkier. Accordingly, there is the disadvantage that a large amount of space is required by the intake manifold etc. in the small engine compartment.

Note that as a means appearing at first glance to be similar to the means of solution of the present invention explained in detail later, there are the two- or more multiple-layer configurations of the intake passages of intake apparatuses of the engines disclosed in Japanese Unexamined Patent Publication (Kokai) No. 62-288318 and Japanese Unexamined Patent Publication (Kokai) No. 1-318756, but the multiple-layer configuration portions of these intake passages are at the upstream sides of the throttle valves. Not only is there a clear difference in configuration from the present invention, but also completely different actions and effects can be expected to be exhibited from the present invention. Further, in the structure of the intake pipe disclosed in Japanese Unexamined Utility Model Publication (Kokai) No. 2-119963, an intake deflection member was provided at the downstream side of the throttle valve, but this constitutes the inflow port of the exhaust gas flowing into the intake pipe for exhaust gas recirculation (EGR) and has a completely different object and different configuration, action, and effect from the present invention.

SUMMARY OF THE INVENTION

The present invention has as its object to deal with the problems of the related art explained above and devise a relatively simple means enabling provision of an apparatus which effectively prevents the flow noise generated from a throttle valve and which does not have any adverse effect on the operation of the engine and does not pose a problem in terms of cost, weight, or space.

To achieve the above-mentioned object, the present invention takes note of the cause of the generation of noise, that is, the fact that the causative factor of flow noise generated when a throttle valve provided in the intake system or the exhaust system is made to rapidly open from the fully closed state is that while small clearances are formed between the throttle valve and the inside wall of the throttle body at two locations, that is, at the upper side and lower side of the throttle valve (when the shaft of the throttle valve is supported horizontally) when the throttle valve starts to open as shown in FIG. 5 and fast flows of air are generated at two locations at the downstream side of the throttle valve, a roundabout flow R due to a slow flow of air is generated at the downstream side of the portion other than the clearances, turbulence T is created due to the interaction of the plurality of air flows with the different flow rates and pressures, and swirls of complicated and unstable flows are caused. As a means of solving the above problems, it provides an apparatus for prevention of the flow noise of a throttle valve as disclosed in the claims. That is, the present invention either provides a pair of means for imparting resistance to the flows $H_1$ and $H_2$ passing through the pair of clearances formed in the air passage at the downstream side of the throttle valve, for example, at the peripheral portions of the throttle valve; provides a pair of means for causing turbulence along the inside wall of the passage at the downstream side of the pair of clearances and imparts positional deviation in the direction of flow to the pair of means so as to cause the flow rates of the flows $H_1$ and $H_2$ occurring in the clearances above and below the throttle valve to decrease; or otherwise provides, at the downstream side of at least one of the pair of clearances, a means acting on the flow of the air passing through the clearance so as to reduce the flow rate and uses that means to shift the point of convergence of the flows passing through the pair of clearances to the downstream side so as to suppress large disturbances in the flow and prevent the occurrence of flow noise.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

Figure 6:
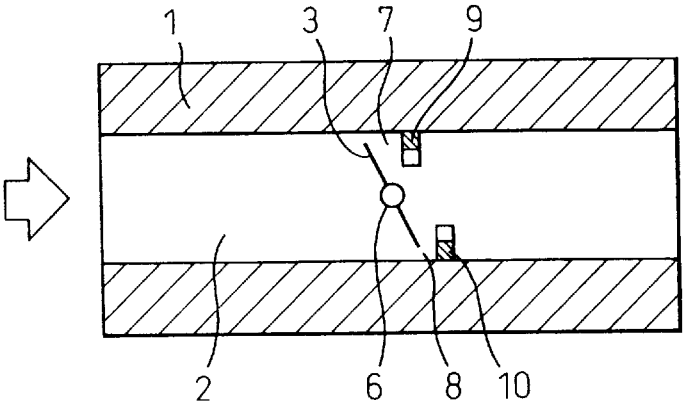
FIG. 6 is a longitudinal sectional front view of an apparatus for prevention of flow noise according to a first embodiment of the present invention.
Figure 7:
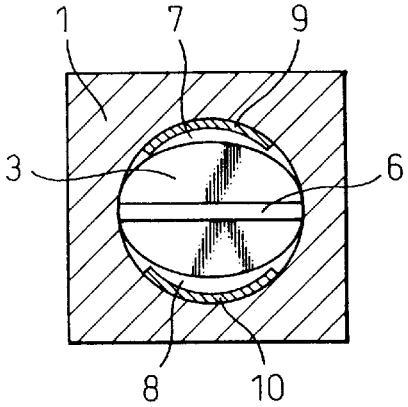
FIG. 7 is a lateral sectional side view of the first embodiment.

FIG. 6 and FIG. 7 show an apparatus for prevention of flow noise according to a first embodiment of the present invention. In this example, arc-shaped members 9 and 10 are provided in an air passage 2 directly downstream of a butterfly type throttle valve 3 as close as possible to the throttle valve 3 corresponding to upper and lower clearances 7 and 8 formed when a shaft 6 of the throttle valve 3 is supported horizontally as means for creating flow resistance. The high speed flows of intake air occurring at the downstream sides of the clearances 7 and 8 formed in the initial period when the throttle valve 3 opens are made to strike the arc-shaped members 9 and 10 to cause the flow rates to fall and the flows to be reduced. The arc-shaped members 9 and 10 may be formed by adhering flexibly bending strip-like members to the inner wall of the throttle body 1.

Figure 8:
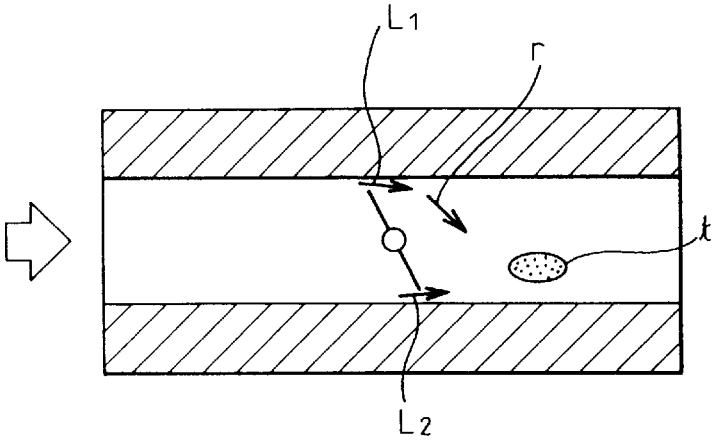
FIG. 8 is a longitudinal sectional front view for explaining the action and effect of the first embodiment.

By this, as shown in FIG. 8, the amount of roundabout flow R when the low speed flows of air $L_1$ and $L_2$ passing through the upper and lower clearances 7 and 8 of the throttle valve 3 converge becomes smaller and it is possible to prevent major disturbances in the flow, so it is possible to suppress the flow noise occurring due to the relatively small disturbance t of the flow. Note that the arc-shaped members 9 and 10 may be of lengths of about 60° in terms of arcs and may be provided as close to the throttle valve 3 as possible without interfering with the throttle valve 3.

Figure 9:
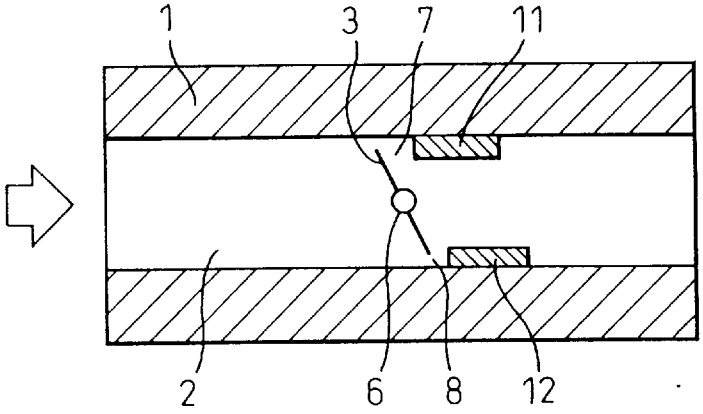
FIG. 9 is a longitudinal sectional front view of an apparatus for prevention of flow noise according to a second embodiment of the present invention.
Figure 10:
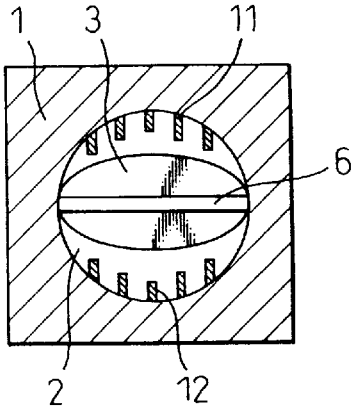
FIG. 10 is a lateral sectional side view of the second embodiment.
Figure 11:
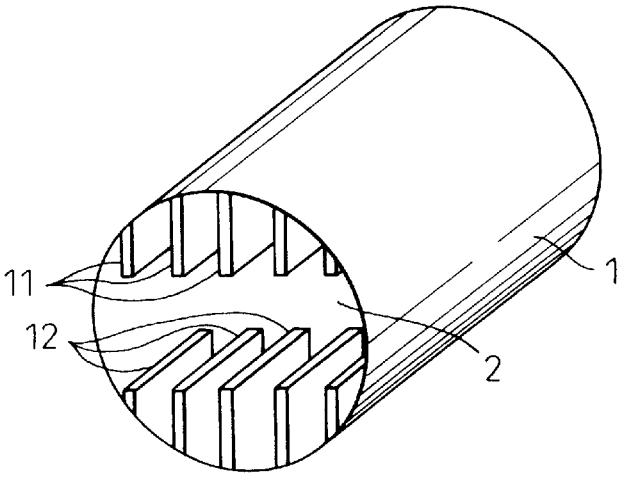
FIG. 11 is a perspective view of the second embodiment.

FIG. 9 to FIG. 11 show an apparatus for preventing flow noise according to a second embodiment of the present invention. In this example, the means for creating flow resistance comprise pluralities of upper and lower fins 11, 12 provided on the inner wall of the air passage 2 parallel to the center axis of the air passage 2. In this case, the high speed flows of air passing through the clearances 7 and 8 encounter resistance due to viscous friction when flowing through the plurality of fins 11 and 12, so the flow rates and flows both drop and the noise is reduced. Further, the fins 11 and 12 have a flow baffling action as well.

Figure 12:
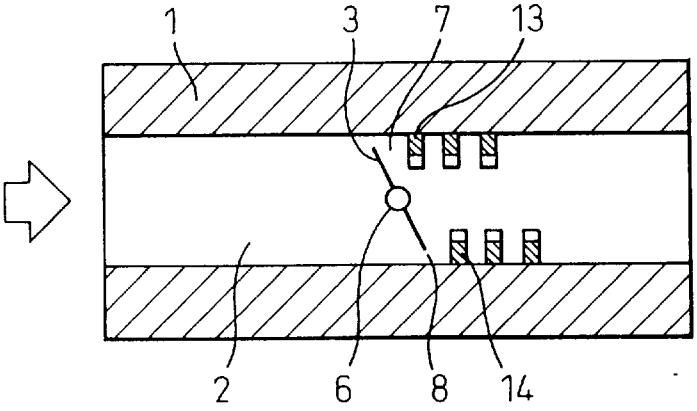
FIG. 12 is a longitudinal sectional front view of an apparatus for prevention of flow noise according to a third embodiment of the present invention.
Figure 13:
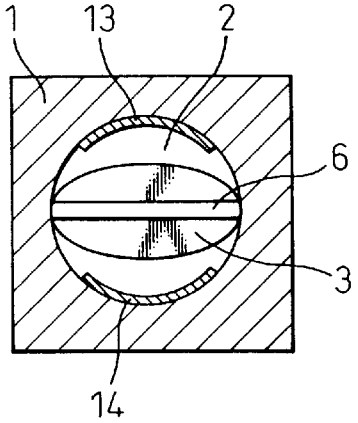
FIG. 13 is a lateral sectional side view of the third embodiment.
Figure 14:
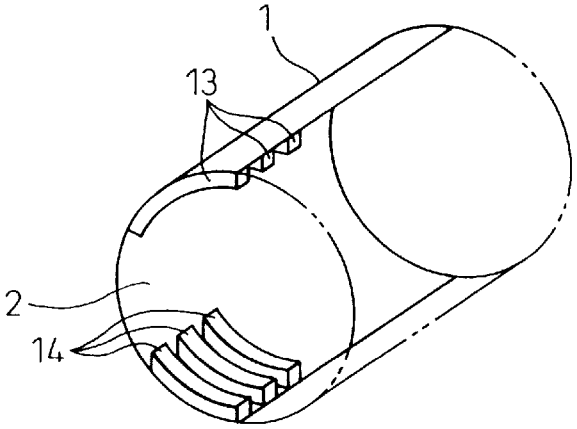
FIG. 14 is a perspective view of the third embodiment.

FIG. 12 to FIG. 14 show an apparatus for preventing flow noise according to a third embodiment of the present invention. In this example, the means for creating resistance are comprised of pluralities of arc-shaped fins 13 and 14 arranged in the circumferential direction on the upper and lower parts of the inner wall of the throttle body 1. In this example, arc-shaped fins 13 and 14 are provided in the same way as in the first embodiment, but their numbers are greater, so the action in reducing the flow rates becomes stronger and the effect of suppression of noise becomes greater, but the resistance to the air flow when the throttle valve 3 is opened widely also becomes greater.

Figure 15:
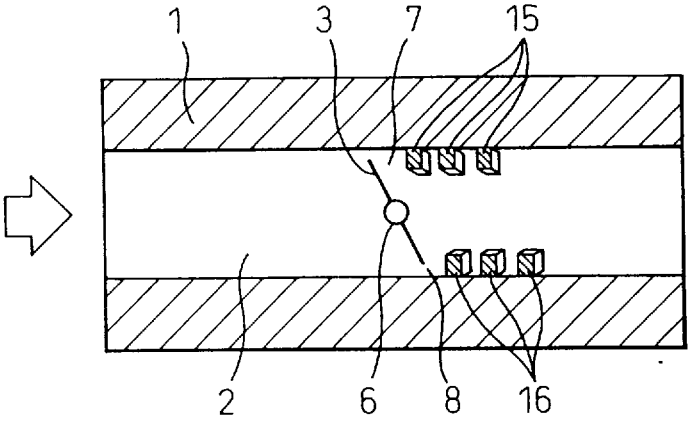
FIG. 15 is a longitudinal sectional front view of an apparatus for prevention of flow noise according to a fourth embodiment of the present invention.
Figure 16:
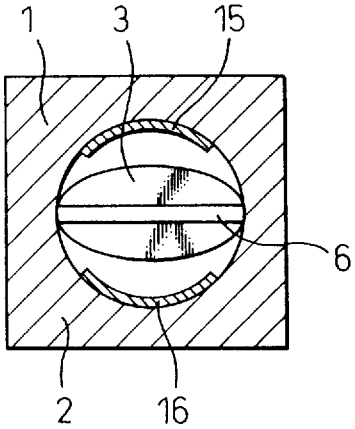
FIG. 16 is a lateral sectional side view of the fourth embodiment.
Figure 17:
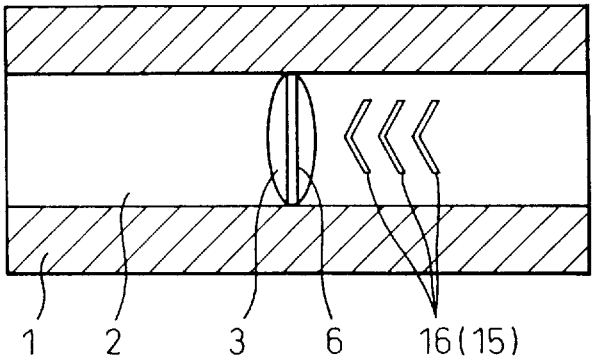
FIG. 17 is a perspective view of the fourth embodiment.

FIG. 15 to FIG. 17 show an apparatus for preventing flow noise according to a fourth embodiment of the present invention. In this example, the means for creating resistance are comprised of pluralities of upper and lower barriers 15 and 16 provided on the upper and lower parts of the inner wall of the throttle body 1 bent at the middle to form chevron shapes inclined to the downstream side as shown in FIG. 17. Since the barriers 15 and 16 are chevron shaped, not only is resistance imparted to the flow of air passing through the clearances 7 and 8, but also some baffling action occurs.

In this way, the apparatuses for prevention of flow noise of the first embodiment to the fourth embodiment differ from each other in the shape of the means for creating flow resistance, but act to create similar flows of air and reduce the flow noise.

Figure 18:
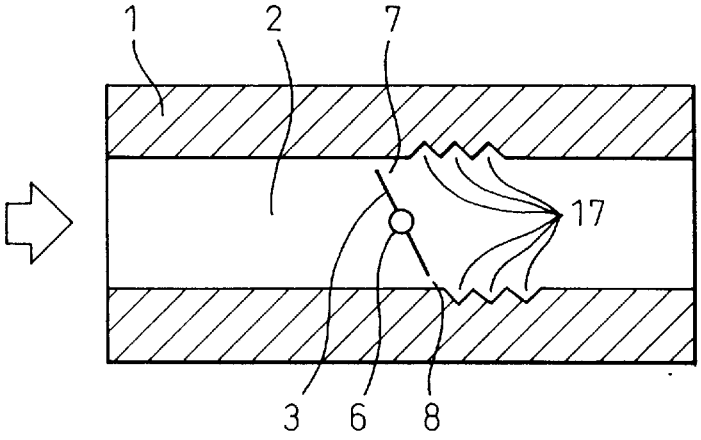
FIG. 18 is a longitudinal sectional front view of an apparatus for prevention of flow noise according to a fifth embodiment of the present invention.
Figure 19:
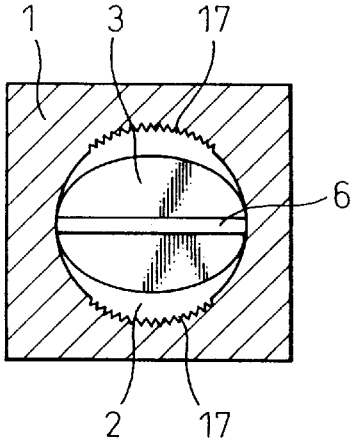
FIG. 19 is a lateral sectional side view of the fifth embodiment.
Figure 20:
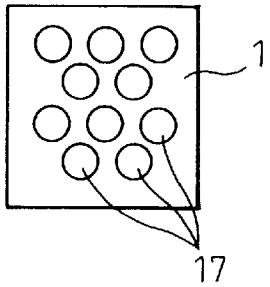
FIG. 20 is a perspective view of the fifth embodiment.

FIG. 18 to FIG. 20 show an apparatus for preventing flow noise according to a fifth embodiment of the present invention. In this example, as means for making the flows near the surface of the inner wall turbulent, a plurality of dimples 17 are provided near to the throttle valve 3 at the surface of the inner wall, including the upper and lower parts of the throttle body 1, at the downstream side just after the throttle valve 3. The high speed flows of air occurring at the upper and lower clearances 7 and 8 formed in the initial period when the throttle valve 3 opens are made turbulent by the dimple-like surfaces of the inner wall. The interface layer of the laminar flow and the turbulence is brought closer to the surface of the inner wall of the throttle valve 1 by this to prevent the flows above and below the throttle valve 3 from converging and causing a large disturbance in the flow. Accordingly, by just forming the dimples 17 at the surface of the inner wall of the throttle body 1, it is possible to suppress the flow noise occurring due to disturbance of the flow without the problem of interference with the range of operation of the throttle valve 3. Note that the dimples 17 are not limited to the circular shapes shown in FIG. 20 and may be made any shape. The depth and sectional shapes may also be freely selected.

Figure 21:
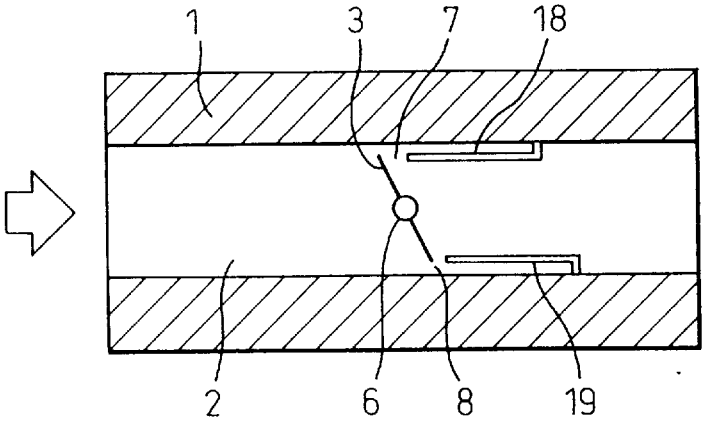
FIG. 21 is a longitudinal sectional front view of an apparatus for prevention of flow noise according to a sixth embodiment of the present invention.
Figure 22:
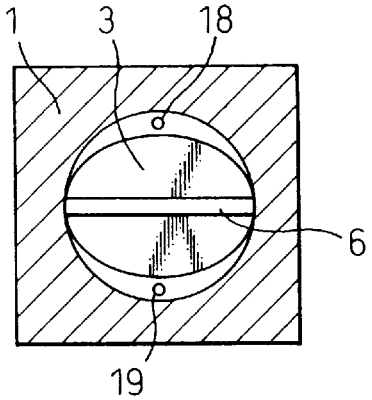
FIG. 22 is a lateral sectional side view of the sixth embodiment.
Figure 23:
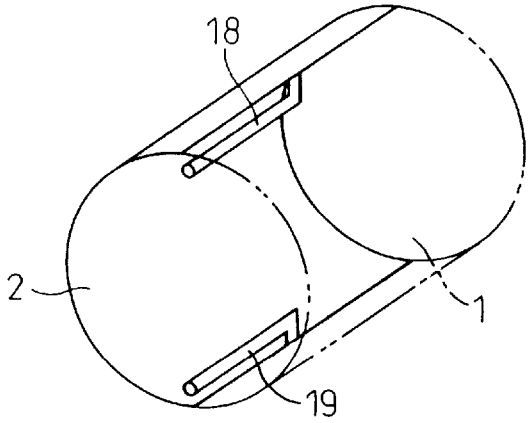
FIG. 23 is a perspective view of the sixth embodiment.

FIG. 21 to FIG. 23 show an apparatus for preventing flow noise according to a sixth embodiment of the present invention. In this example, as the means for making the flows turbulent, tripping wires 18 and 19 are attached at the downstream side of the throttle valve 3 at the upper and lower parts of the surface of the inner wall of the throttle body 1. The tripping wires 18 and 19 are made of metal wires etc. When made L-shaped as illustrated, one end of each is affixed to the surface of the inner wall of the throttle body 1, while when made U-shaped, the two ends are attached to the surface of the inner wall. The longitudinal portions of the tripping wires 18 and 19 parallel to the center axis of the throttle body 1 cause the formation of small turbulence at the flows passing through the clearances 7 and 8, so the air flows in a manner generally the same as that due to the dimples 17 of the fifth embodiment.

Note that the embodiments illustrated had the means for creating resistance or the means for producing turbulence provided at the surface of the inner wall of the throttle body 1, but these need only be provided at the inner side of the walls forming the air passage 2 at the downstream side of the throttle valve 3, so do not necessarily have to be provided at the surface of the inner wall of the throttle body 1. If the downstream side of the throttle valve 3 is connected immediately to the intake manifold portion, these means may be provided at that inner wall. Further, if the throttle valve 3 is provided in the exhaust passage, the air passage 2 is needless to say the exhaust passage through which the exhaust gas flows.

In the illustrated embodiments, the means for creating flow resistance (barriers and fins) or the means for making the flow turbulent (dimples and tripping wires) etc. are provided as close as possible to the walls forming the air passage, so it is possible to keep the reduction of the cross-sectional area of the air passage (section perpendicular to the overall direction of flow of air) to a minimum. Accordingly, it is possible to reduce the pressure loss compared to the metal net used in the related art and therefore prevent deterioration of the engine performance.

Figure 24:
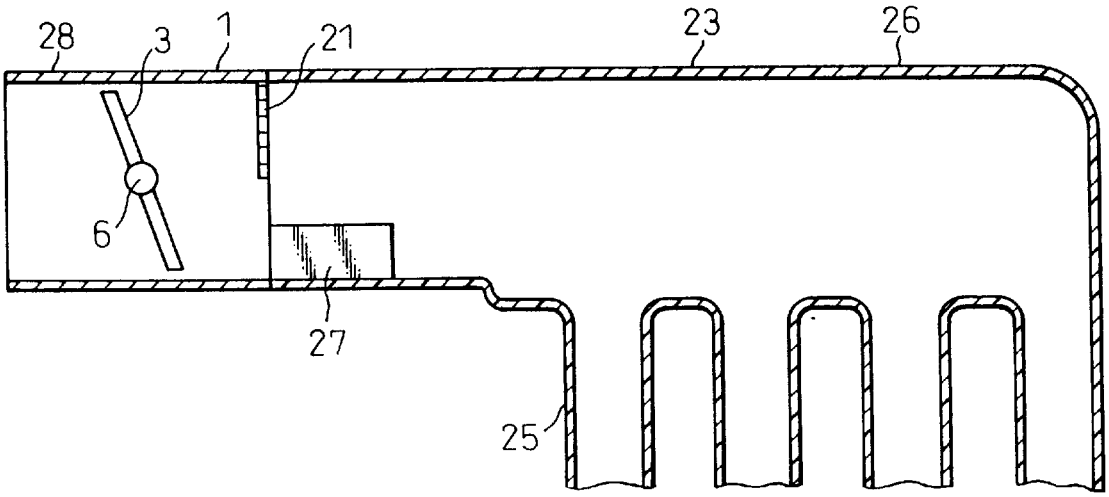
FIG. 24 is a schematic sectional view of a structure for reducing noise according to a seventh and eighth embodiment.
Figure 25:
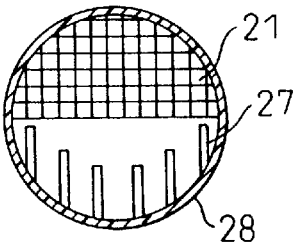
FIG. 25 is a schematic front view of a net and baffle plate portion of a structure for reducing noise of the seventh embodiment of the present invention.
Figure 26:
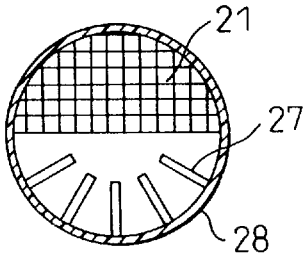
FIG. 26 is a schematic front view of a net and baffle plate portion of a structure for reducing noise of the eighth embodiment of the present invention.
Figure 27:
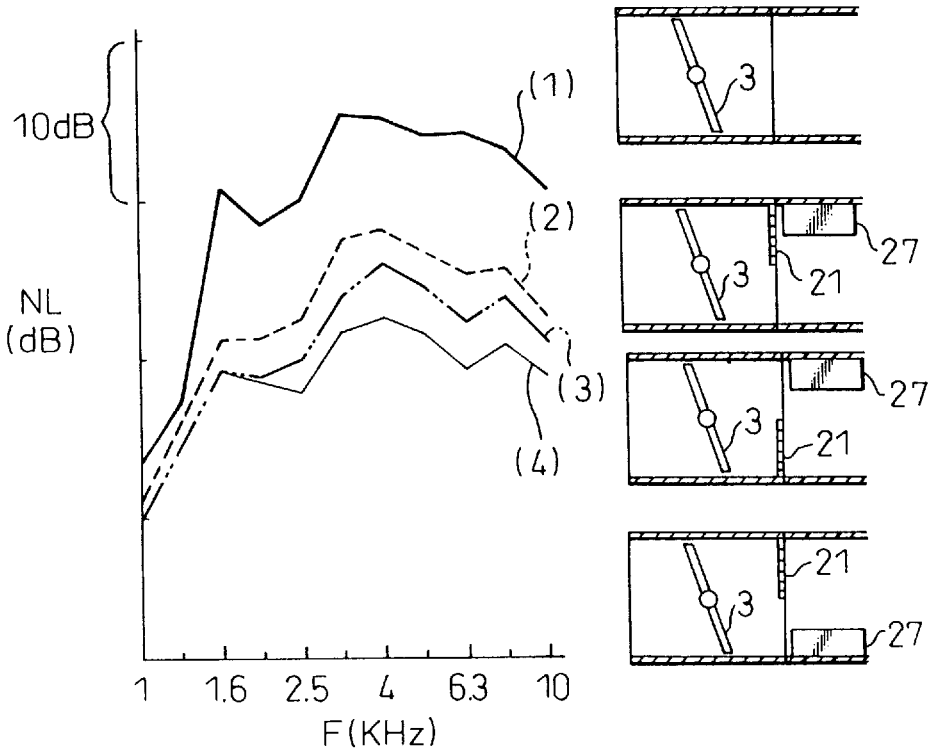
FIG. 27 is a graph of the characteristics of reduction of noise of the structures of the present invention and the structures of comparative examples (including the related art)

FIG. 24 and FIG. 25 show a seventh embodiment of the present invention, FIG. 26 shows an eighth embodiment of the present invention, and FIG. 27 shows the effect of reduction of noise resulting from these embodiments. In the figures, the structural portions common to the two embodiments are indicated by the same reference numerals throughout the explanation.

The parts of the structure common to the seventh and eighth embodiments of the present invention will be explained next referring to FIG. 24 and FIG. 25.

The noise reducing structure of these two embodiments comprises a throttle valve 3 disposed in the intake passage of an automobile engine, an intake manifold surge tank 23 downstream of the same, a net 21 disposed immediately downstream of the throttle valve 3 at part of the lateral cross-section of the intake passage, and a plurality of baffle plates 27 disposed immediately downstream of the throttle valve 3 at least at part of the portion where the net 21 is not disposed in the lateral cross-section of the intake passage. The intake air passes through the clearances between the throttle valve 3 and the passage wall 28 and then passes through the net 21 and the barrier plates 27, flows to the intake manifold surge tank 23, and then flows inside an engine cylinder.

The throttle valve 3 is normally made of a metal and is disposed in the throttle body 1. The throttle valve 3 is comprised of a butterfly type valve and pivots about a center axis of rotation to open and close the passage. When the throttle valve 3 opens, one side of throttle valve 3 from the center axis (upper side in the illustration) pivots in toward the upstream side, while the other side (lower side in the illustration) pivots in toward the downstream side.

The intake manifold surge tank 23 is comprised of an intake manifold portion 25 and a surge tank 26. The intake manifold surge tank 23 is made of a plastic or a metal and is connected to the throttle body 1 via the net 21. When the intake manifold surge tank 23 is made of a plastic, the intake manifold portion 25 and the surge tank 26 are formed as one piece. When the intake manifold surge tank 23 is made of a plastic, further, the baffle plates 27 may also be fabricated by molding as one piece.

The intake manifold surge tank 23 may however also be made of a metal (for example, made of aluminum).

A metal spacer may be interposed between the intake manifold surge tank 23 and the metal throttle body 1. In this case, the net 21 is disposed sandwiched between the throttle body 1 and the spacer.

The net 21 is arranged at least at a position struck by the intake air flowing through the clearance between the portion of the throttle valve 3 which pivots in toward the upstream side when the valve opens and the passage wall 28. The baffle plates 27 are arranged at positions struck by the intake air flowing through the clearance between the portion of the throttle valve 3 which pivots in toward the downstream side when the valve opens and the passage wall 28.

Next, the action of the above structure will be explained.

In the present invention, since the net 21 is provided at least at part of the lateral cross-section of the intake passage and the baffle plates 27 are provided at least at part of the portion where the net is not provided in the lateral cross-section of the intake passage, as shown in FIG. 27 (in the case where the intake manifold surge tank is made of a plastic), a greater noise reducing effect is obtained than (1) when the baffle plates are not provided and (2) the net 21 and the baffle plates 27 are simply provided (when the net 21 and the baffle plates 27 are provided overlapping each other in the lateral cross-sectional direction of the passage). Further, the present invention, as shown in FIG. 27, includes (3) the case where baffle plates 27 are provided at the half section of the side where the throttle valve 3 pivots in toward the upstream direction when the throttle valve opens and the net 31 is provided at the half section of the side where the throttle valve 3 pivots in toward the downstream side when the throttle valve opens and (4) the case where the net 21 is provided at the half section of the side where the throttle valve 3 pivots in toward the upstream direction when the throttle valve opens and the baffle plates 27 are provided at the half section of the side where the throttle valve 3 pivots in to the downstream side when the throttle valve opens, but a greater noise reducing effect is obtained in the case (4) than the case (3). Note that in the graphs of FIGS. 27 and 28, the NL of the vertical axis shows the noise level (one gradation indicating 10 dB), while the F of the horizontal axis shows the center frequency of ⅓ octave.

The reason for the reduction of the noise will be explained next.

When the flow was analyzed, it was found that the flow passing through the clearance between the portion of the throttle valve 3 which pivots in to the upstream side when the valve opens and the passage wall 28 had a large effect on the generation of noise. As shown by (1), when neither the net 21 nor the baffle plates 27 are provided (related art), the flow passing through the clearance between the portion of the throttle valve 3 which pivots in to the upstream side when the valve opens and the passage wall 28 forms a first disturbance when passing through the throttle valve portion and is drawn to the center of the pipe seen from a plan view. The left and right flows converge to form the second disturbance there. The air flows downward at an angle from there and collides with the flow passing through the clearance between the portion of the throttle valve 3 which pivots in toward the downstream side when the valve opens and the passage wall 28 so as to form a third disturbance. The disturbance of the flow causes a high frequency fluctuation in pressure. This causes the passage wall 28 to vibrate and causes noise. The noise is particularly great when the passage wall 28 is made of a plastic.

In the present invention, by providing the net 21, the level of the disturbance of the portion of the first disturbance downstream of the net 21 is reduced. Further, downstream of the net 21, the flow resistance of the net 21 causes the flow rate of the high speed portion to fall and eases the convergence of the left and right flows and the collision with the flow passing through the clearance between the portion of the throttle valve 3 which pivots in toward the downstream side when the valve opens and the passage wall 28, resulting in a reduction of the second and third disturbances as well. The effect of the net 21 in reducing the disturbance is largest when providing the net 21 at a position struck by the flow passing through the clearance between the portion of the throttle valve 3 which pivots in toward the upstream side when the valve opens and the passage wall 28. Accordingly, by providing the net 21 at a position struck by the flow passing through the clearance between the portion of the throttle valve 3 which pivots in toward the upstream side when the valve opens and the passage wall 28, it is possible to reduce the first, second, and third disturbances and suppress the vibration of the passage walls and the occurrence of noise.

Note that the disturbance of the portion upstream of the net 21 remains as it is, but the passage wall of the portion upstream from the net 21 is resistant to vibration since it is part of the throttle body 1 itself and made of metal. There is no problem with the generation of noise.

Further, in the present invention, by providing the baffle plates 27, in the case of (4) of FIG. 27, when the flow passing through the clearance between the portion of the throttle valve 3 which pivots in toward the downstream side when the valve opens and the passage wall 28 reaches the position of the baffle plates 27, the dispersion of the flow in the right-left direction is suppressed and the movement of what flow is dispersed in the left-right direction upward along the passage wall is suppressed, so the point at which the flow moves upward is shifted to the downstream side, collision with the flow descending from above becomes more difficult, and generation of the third disturbance becomes more difficult. Due to this, the noise is further reduced compared with the case where just the net 21 is provided. A similar effect is obtained in the case of (3) of FIG. 27. As shown by (2) of FIG. 27, however, even when the net 21 and the baffle plates 27 are provided at the same side, the effect of prevention of the third disturbance by the prevention of collision of the flows from above and below is not obtained, so the noise reducing effect of the baffle plates 27 is not obtained. The case of (2) is therefore not included in the present invention.

Next, an explanation will be made of the structures and actions unique to the ninth and 10th embodiments of the present invention not having the net.

The ninth embodiment of the present invention, like the seventh embodiment shown in FIG. 25, has a plurality of baffle plates 27 arranged in parallel with each other and disposed in a direction perpendicular to the center axis of rotation of the throttle valve 3. The baffle plates 27 may be any height. The front ends of the baffle plates may extend up to the diameter position of the passage (baffle plates may be different from each in height) and, as shown in FIG. 25, the plurality of baffle plates 27 may be substantially constant in height.

The 10th embodiment of the present invention, like the eighth embodiment shown in FIG. 26, has a plurality of baffle plates 27 disposed on lines extending radially from the center axis of the passage. The baffle plates 27 may be of any heights. As shown in FIG. 26, the baffle plates 27 may also be substantially constant in height.

Figure 28:
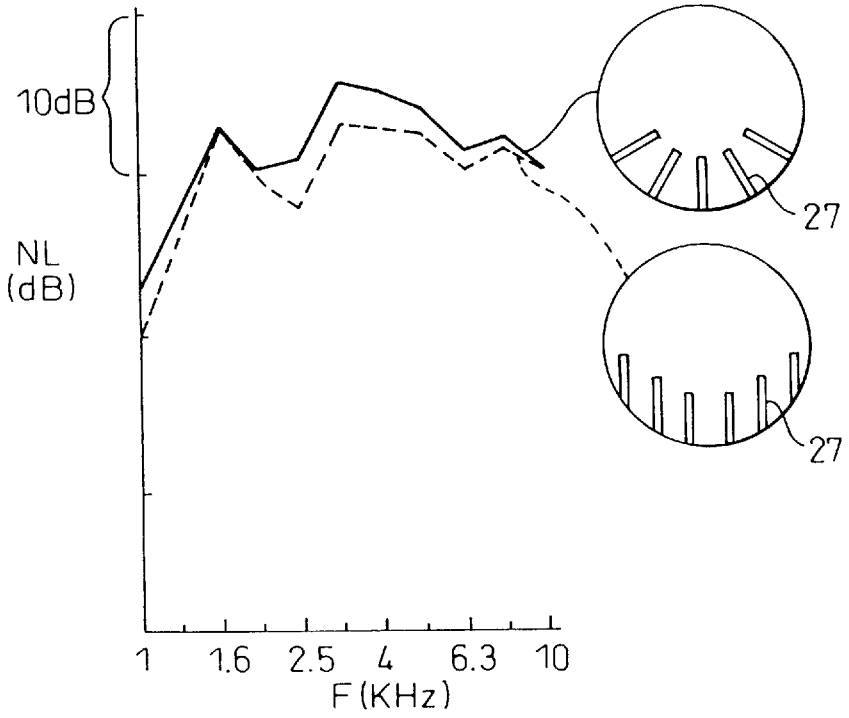
FIG. 28 is a graph of the characteristics of reduction of noise of the structures of a ninth embodiment and 10th embodiment of the present invention.

Looking at the actions and effects of the ninth embodiment and the 10th embodiment of the present invention, as shown in FIG. 28, both embodiments are superior in the noise reducing effect. In particular, in the high frequency region (1.5 kHz or more), the ninth embodiment with the baffle plates parallel with each other has a noise reducing effect about 2.5 dB greater than the 10th embodiment with the baffle plates arranged radially.

Figure 1:
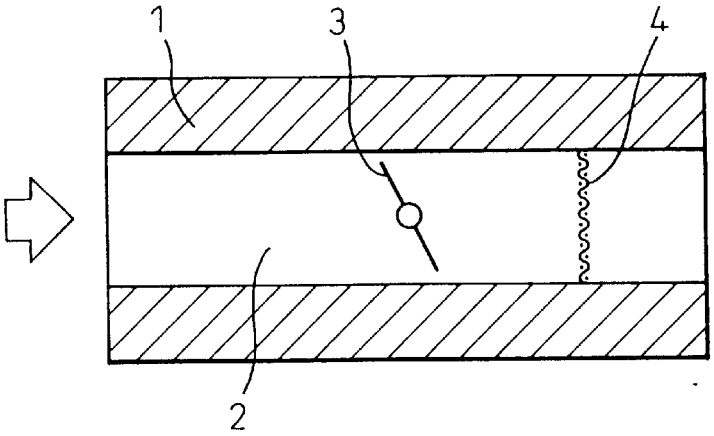
FIG. 1 is a longitudinal sectional front view of a first related art of an apparatus for prevention of flow noise.
Figure 2:
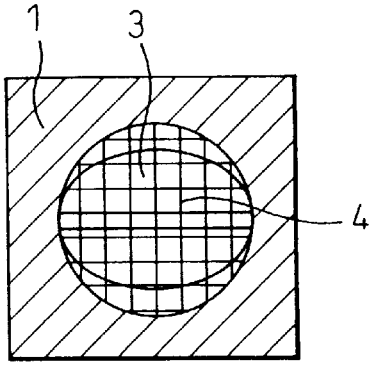
FIG. 2 is a lateral sectional side view of the first related art.
Figure 3:
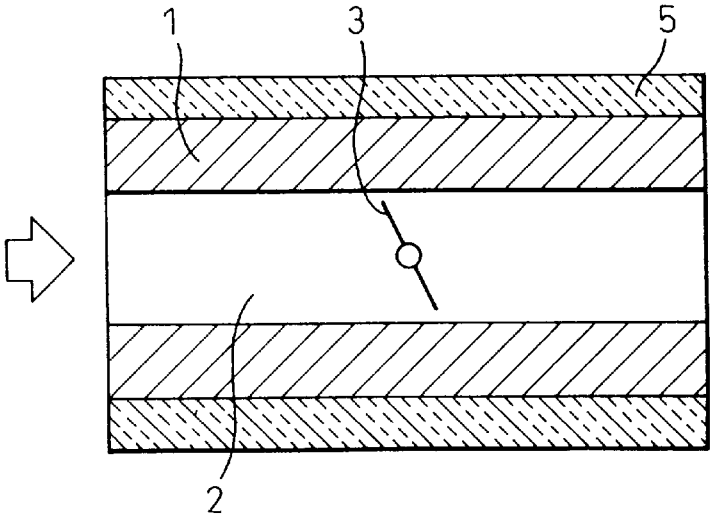
FIG. 3 is a longitudinal sectional front view of a second related art of an apparatus for prevention of flow noise.
Figure 4:
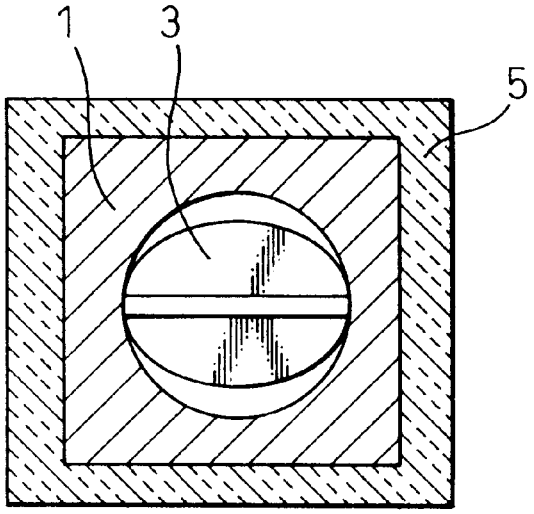
FIG. 4 is a lateral sectional side view of the second related art.
Figure 5:
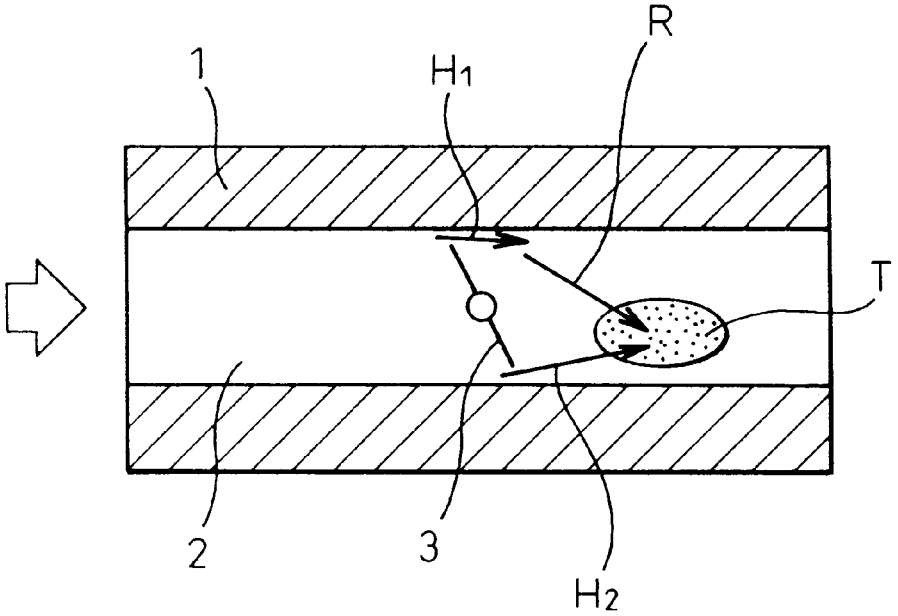
FIG. 5 is a longitudinal sectional front view of the area around a throttle valve for explaining the causes of occurrence of noise.
Figure 29:
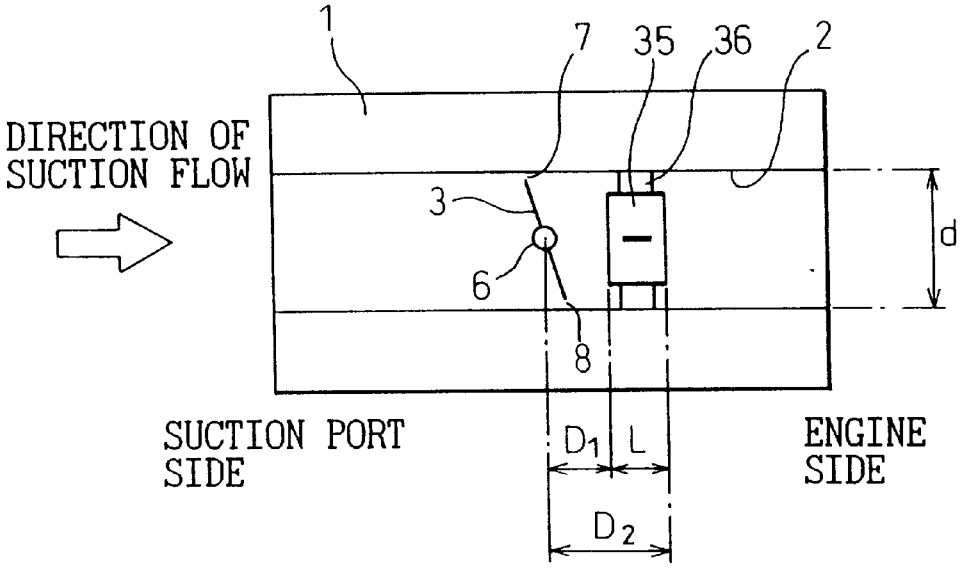
FIG. 29 is a longitudinal sectional front view of an apparatus of an 11th embodiment of the present invention.
Figure 30:
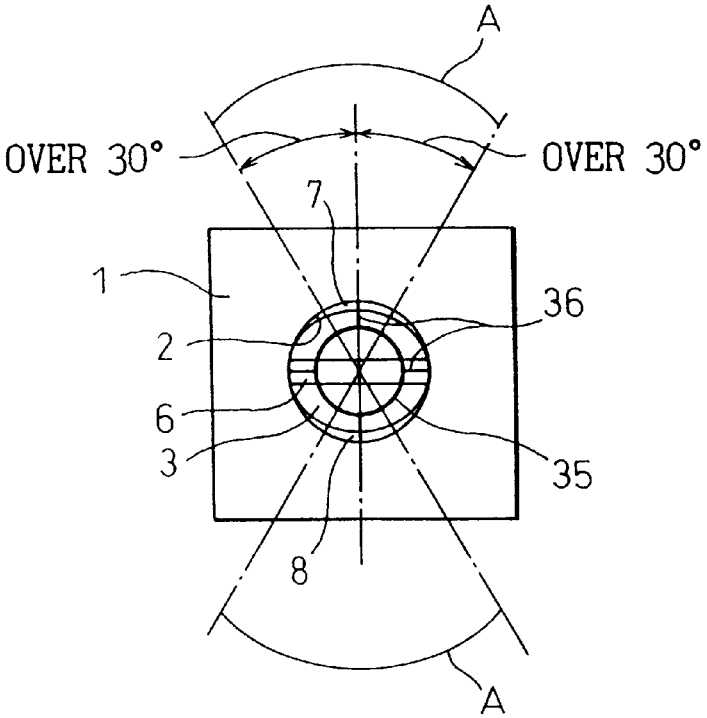
FIG. 30 is a lateral sectional side view of the apparatus of the 11th embodiment.

FIG. 29 and FIG. 30 show an 11th embodiment of the present invention. Portions substantially the same as the structures in FIG. 1 and FIG. 2 showing the related art, explained earlier, and other embodiments are given the same reference numerals. That is, reference numeral 1 denotes a throttle body, 2 an intake passage formed inside the same, and 3 a butterfly type throttle valve provided so as to open and close the intake passage 2. The 11th embodiment is characterized in that a relatively thin short cylinder 35 dividing the intake passage 2 into an outer peripheral portion and a center portion is inserted in the intake passage at the downstream side (engine side) of the throttle valve 3. This is affixed and supported a predetermined clearance from the inner wall of the intake passage 2 by upper and lower and right and left fin-shaped supports aligned in the direction of flow of the intake air. By inserting this cylinder 35, the part of the intake passage at the downstream side of the throttle valve 3 becomes a double-layer structure. When the upstream end of the cylinder 35 moves considerably away from the throttle valve 3, the noise reduction effect becomes smaller, so the cylinder 35 is placed as near to the throttle valve 3 as possible while avoiding the range of operation of the throttle valve 3.

Giving a specific example, the distance $D_1$ between the center of the shaft 6 of the throttle valve and the upstream end of the cylinder 35 should be not more than 0.5 d, where d is the diameter of the intake passage 2. Further, the distance $D_2$ between the center of the shaft 6 of the throttle valve 3 and the downstream end of the cylinder 35 similarly should be made at least 0.7 d. As a result, the length L of the cylinder 35 seen from the direction of flow preferably is made at least 0.2 d.

Since the 11th embodiment is configured in this way, when the throttle valve 3 is made to rapidly open from the fully closed state, first fast flows of intake air are caused flowing through the small clearances 7 and 8 formed first between the throttle valve 3 and the inner wall of the intake passage 2 and following the wall surface. These flows of intake air mainly pass through the outer side due to the partitioning action of the cylinder 35. Almost none flow to the center portion at the inside of the cylinder 35. Therefore, even if the flow rates and pressures of the flows of intake air differ largely between the outer peripheral portion and center portion of the cylinder 35 directly after the throttle valve 3, due to the baffling action of the cylinder 35, the inside and outside flows of intake air are oriented in direction, then converge smoothly at the downstream side of the cylinder 35, so there is no occurrence of disturbance in the flow of intake air due to the occurrence of complicated, unstable eddies and, as a result, the flow noise is reduced. It goes without saying that in a state where the throttle valve 3 is opened widely, the flow rates and pressures at the downstream side of the throttle valve 3 become substantially uniform at all locations, so the flow noise due to disturbances in the flow of intake air inherently does not occur.

In the configuration of the 11th embodiment, in the state where the opening degree of the throttle valve 3 in question is small, the fast flow of intake air passing through the outer peripheral portion of the cylinder 35 is blocked only by the small surface areas of the fin-like supports 36 of the cylinder 35 seen in the direction of flow of the intake air. Even in the state where the throttle valve 3 is opened wide, just the small surface area of the relatively thin cylinder 35 seen in the direction of flow of the intake air is added to this area. Therefore, the pressure loss is small and it is possible to prevent a deleterious effect on the engine due to the provision of the apparatus for preventing flow noise. Further, the cylinder 35 is a small part placed in the intake passage 2, so the bulkiness is not increased and the cost does not rise that much.

Note that in the 11th embodiment, the cylinder 35 was provided in the intake passage 2 inside the throttle body 1, but the cylinder 35 does not have to be placed at a position inside the throttle body 1. It is sufficient that it be in the intake passage at the downstream side directly after the throttle valve 3, for example, needless to say, it may be in the region of the intake manifold. Further, in the 11th embodiment, the cylinder 35 was used, but the means for forming the intake passage 2 into a double inside and outside configuration does not necessarily have to be a cylinder in the strict sense of the word. For example, it is also possible to use a polygonal cross-section tube etc. As a modification, it is also possible to concentrically provide a plurality of large and small cylinders 35 spaced from each other by predetermined distances. This strengthens the effect of prevention of flow noise.

Further, when the shaft 6 of the throttle valve 3 is horizontal, the throttle valve 3 initially opens at the upper and lower clearances 7 and 8, so the cylinder 35 provided as the guide means of the flow of intake air has an effective baffling action mainly at portions corresponding to the clearances 7 and 8. Therefore, as a modification of the first embodiment, upper and lower guide pieces comprising, as it were, the cylinder 35 with just the portions effective in the baffling action left and the rest cut away, may be affixed and supported by supports 36 at predetermined intervals from the inner wall of the intake passage 2. A considerable effect of suppressing flow noise is obtained from this alone. The range of provision of these arc-shaped guide pieces is shown as A in FIG. 30 The range of provision A of the upper and lower guide pieces is at least 30° in the left-right direction of the vertical axis, therefore it is possible to use arc-shaped guide pieces extending over 60° above and below. Note that the guide pieces act to partition the outer peripheral portion and center portion of the intake passage 2, so may also be called partition plates.

Figure 31:
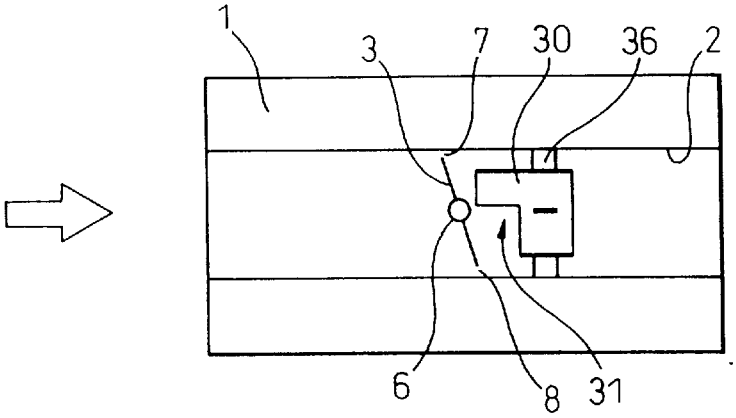
FIG. 31 is a longitudinal sectional front view of an apparatus of a 12th embodiment of the present invention.
Figure 32:
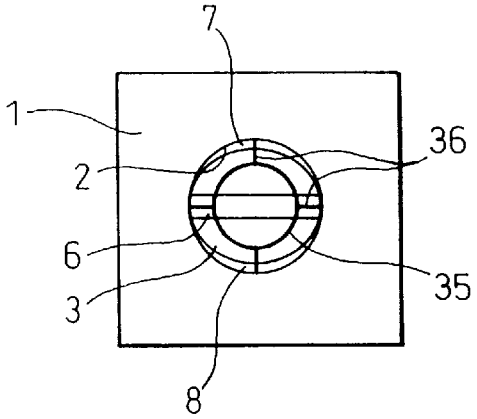
FIG. 32 is a lateral sectional side view of the apparatus of the 12th embodiment.
Figure 33:
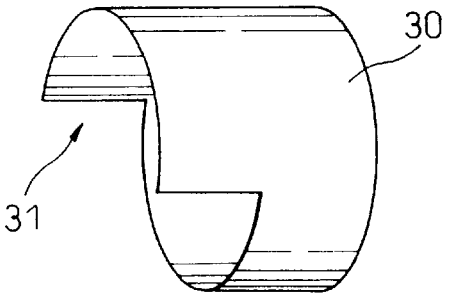
FIG. 33 is a perspective view of key parts of the apparatus of the 12th embodiment.

FIG. 31 to FIG. 33 show a 12th embodiment of the present invention. The cylinder 35 in the 11th embodiment (or the two guide pieces functioning as the effective portions of the same) are placed as near to the throttle valve 3 as possible in the intake passage 2 at the downstream side of the throttle valve 3. When the throttle valve 3 is a butterfly type, however, the upstream end of the cylinder 35 has to be positioned shifted to the downstream side so as not to interfere with the range of operation of the throttle valve 3. The distance $D_1$ shown in FIG. 29 therefore tends to become larger. As a result, the baffling action of the cylinder 35 is weakened somewhat. Accordingly, in the 12th embodiment of the present invention, instead of the cylinder 35, the modified cylinder 30 shown in FIG. 33 is used so as to bring the upstream end of the cylinder 30 as close as possible to the shaft 6 of the throttle valve 3.

The modified cylinder 30 is shaped as a cylinder partially cut away to form a step portion 31. This enables the throttle valve 3 to enter the step portion 31 and thereby prevents interference from the cylinder 30 when the throttle valve 3 opens. Accordingly, the step portion 31 can be said to be a relief portion provided in the cylinder 30. Note that the rest of the configuration and the action and effect of the 12th embodiment are substantially the same as in the 11th embodiment and overlapping explanations are omitted. In this way, in the 12th embodiment, since the upstream end of the cylinder 30 is brought closer to the throttle valve 3 than the case of the 11th embodiment, the cylinder 30 not only can exhibit a superior effect in preventing flow noise due to the higher baffling action than the cylinder 35 in the 11th embodiment, but also does not have a detrimental effect on the engine in the same way as the 11th embodiment. Further, as clear from the explanation of the 11th embodiment, as a modification of the cylinder 30, it is also possible to provide one or more guide pieces corresponding to the effective portions of the same.

Figure 34:
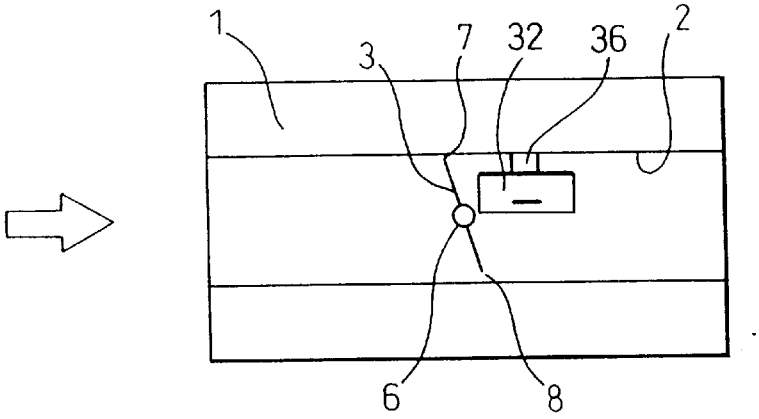
FIG. 34 is a longitudinal sectional front view of an apparatus of a 13th embodiment of the present invention.
Figure 35:
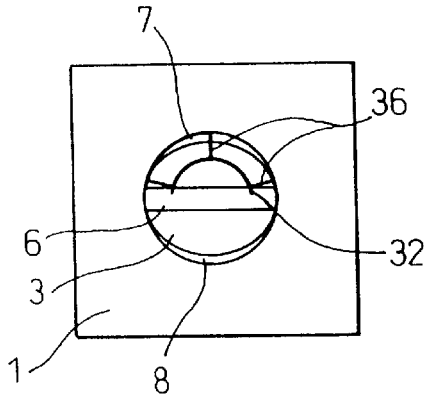
FIG. 35 is a lateral sectional side view of the apparatus of the 13th embodiment.
Figure 36:
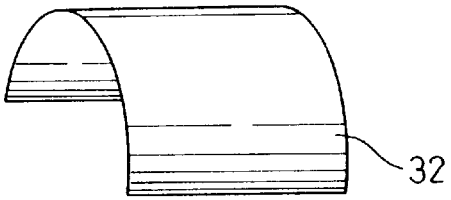
FIG. 36 is a perspective view of key parts of the apparatus of the 13th embodiment.

FIG. 34 to FIG. 36 show a 13th embodiment of the present invention. As explained above, as modifications of these embodiments, the cylinder 35 in the 11th embodiment and the cylinder 30 in the 12th embodiment both may be replaced by separate guide pieces corresponding to the portions of the cylinders 35 and 30 effective in baffling action. The 13th embodiment shows the example of provision of a single guide piece at the minimum necessary position. The guide piece or partition plate 32 characterizing the 13th embodiment, like the guide pieces explained in the modifications of the 11th embodiment and 12th embodiment shown in FIG. 36, is an arc shape corresponding to part of a cylinder. The partition plate 32 is affixed and supported by the supports 36 a predetermined interval away from the inner wall of the intake passage 2. In this example, three supports 36 are provided as illustrated in FIG. 35.

The point of difference of the 13th embodiment from the 11th embodiment is that the partition plate 32 is provided corresponding to the clearance 7, where the disturbance of the flow of intake air tends to occur more easily, among the clearances 7 and 8 occurring first when the throttle valve 3 is opened. When the throttle valve 3 is inclined with respect to the intake passage 2 as shown in FIG. 34, there is a tendency for a stronger disturbance of the flow of intake air to occur at the clearance 7 than the clearance 8, so if providing the partition plate 32 corresponding to just one of the clearances 7 and 8, it is more effective to provide it with respect to the clearance 7. The action and effect of the partition plate 32 in this case need no further explanation and are substantially the same as those of the cylinders 35 and 30.

Figure 37:
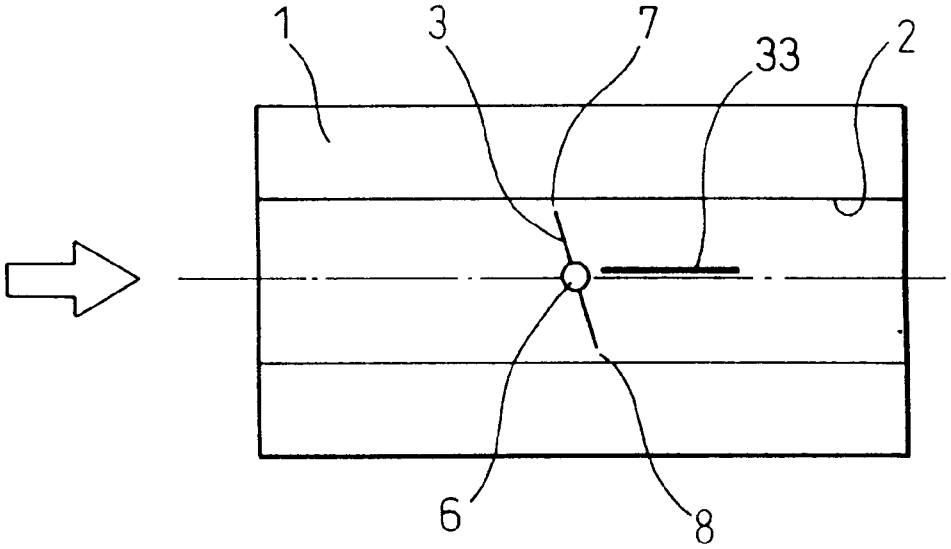
FIG. 37 is a longitudinal sectional front view of an apparatus of a 14th embodiment of the present invention.
Figure 38:
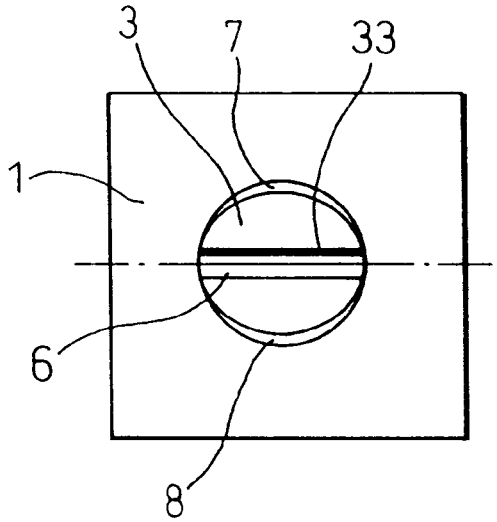
FIG. 38 is a lateral sectional side view of the apparatus of the 14th embodiment.

FIG. 37 and FIG. 38 show a 14th embodiment of the present invention. This example differs from the above embodiments in that a flat partition plate 33 is provided at the downstream side of the throttle valve 3 in parallel to an imaginary plane defined by the center axis of the shaft 6 and the center axis of the intake passage 2 so as to substantially almost entirely overlap the same. Needless to say, the partition plate 33 is affixed and supported shifted slightly away from the imaginary plane so as not to interfere with the butterfly type throttle valve 3 even when it is open to the maximum degree. As clear from FIG. 38, the partition plate 33 of the 14th embodiment has a length in the radial direction sufficient to enable connection of the facing left and right inner walls of the intake passage 2, so can be attached at its two ends to the inner walls of the intake passage 2 directly without use of means such as supports.

In this way, the partition plate 33 in the 14th embodiment divides the intake passage 2 at the downstream side of the throttle valve into two upper and lower portions substantially along the shaft 6, so even if a state of different flow rates and pressures occurs between the upper and lower flows of intake air of the partition plate 33 due to the clearances 7 and 8 occurring first when the throttle valve 3 opens, since the partition plate 33 gives a baffling action separating the upper and lower flows of intake air, the occurrence of disturbance at the upper and lower flows of intake air is suppressed. The flows smoothly converge at the downstream end of the partition plate 33, so occurrence of flow noise due to the disturbance of the flow is prevented. The partition plate 33 of the 14th embodiment can be provided at a position extremely close to the shaft 6 without interfering with the range of operation of the throttle valve 3, so can divide the intake passage 2 downstream of the throttle valve 3 substantially completely. Accordingly, there is the advantage that it is possible to reliably separate the two upper and lower flows of intake air.

Note that while not illustrated, as a modification of the 14th embodiment, it is also possible to provide two or more of the partition plates 33 in parallel. In this case, all of the partition plates except for the single partition plate provided along the shaft 6 of the throttle valve 3 are provided away from the position of the shaft 6, so it is necessary to avoid the range of operation of the throttle valve 3 to prevent interference, but the plurality of partition plates can divide the flow of intake air at the downstream side of the throttle valve 3 into a multitude of layers, so a greater effect in preventing flow noise can be obtained.

While the invention has been described with reference to specific embodiments chosen for purposes of illustration, it should be apparent that numerous modifications could be made thereto by those skilled in the art without departing from the basic concept and scope of the invention.

What is claimed is:

1. An apparatus for preventing flow noise in a throttle valve in an air volume regulating mechanism comprising an air passage provided in an internal combustion engine and a throttle valve pivotally supported by a shaft inside said air passage and causing said throttle valve to pivot around said shaft to change the sectional area of said air passage and thereby regulate the volume of air flowing through said air passage, wherein said throttle valve has one peripheral portion which pivots about said shaft to the downstream side in the direction of flow of air in said air passage when the valve opens and another peripheral portion which pivots to the upstream side of said air passage, and wherein a pair of resistance means for acting on the flows of air passing through the clearances is provided at a downstream side of a pair of clearances formed at portions around said throttle valve most distant from said shaft in the initial period when said throttle valve opens, and wherein the one of said pair of resistance means arranged at said one peripheral portion of said throttle valve is arranged shifted in position to the downstream side of the air passage from the other of said pair of resistance means arranged at said other peripheral portion of said throttle valve.

2. An apparatus for preventing flow noise as set forth in claim 1, wherein said resistance means are each comprised of at least one arc-shaped low barrier formed at a downstream side of a said clearance near to said throttle valve to project to the inside from an inner wall of said air passage and substantially extending in the circumferential direction corresponding to said clearance.

3. An apparatus for preventing flow noise as set forth in claim 2, wherein the two ends of a center portion in the circumferential direction of said arc-shaped low barrier are inclined toward the downstream side of said air passage.

4. An apparatus for preventing flow noise as set forth in claim 2, wherein a plurality of said arc-shaped low barriers are provided in parallel.

5. An apparatus for preventing flow noise as set forth in claim 3, wherein said resistance means are each comprised of at least one fin formed at a downstream side of a said clearance near to said throttle valve to project to the inside from an inner wall of said air passage and extending from a position corresponding to said clearance to the downstream side along a center axis of said air passage.

6. An apparatus for preventing flow noise as set forth in claim 5, wherein a plurality of said fins are provided in parallel along the center axis of said air passage.

7. An apparatus for preventing flow noise in a throttle valve in an air volume regulating mechanism comprising an air passage provided in an internal combustion engine and a throttle valve pivotally supported by a shaft inside said air passage and causing said throttle valve to pivot around said shaft to change the sectional area of said air passage and thereby regulate the volume of air flowing through said air passage, wherein said throttle valve has one peripheral portion which pivots about said shaft to the downstream said in the direction of flow of air in said air passage when the valve opens and another peripheral portion which pivots to the upstream side of said air passage, and wherein a pair of means for creating turbulence in the flows of air passing through the clearances is provided at a downstream side of a pair of clearances formed at portions around said throttle valve most distant from said shaft in the initial period when said throttle valve opens, and wherein the one of said pair of turbulence creating means arranged at said one peripheral portion of said throttle valve is arranged shifted in position to the downstream side of the air passage from the other of said pair of turbulence creating means arranged at said other peripheral portion of said throttle valve.

8. An apparatus for preventing flow noise as set forth in claim 7, wherein said means for generating disturbances is comprised of at least one dimple formed on the inner wall of said intake passage at the downstream side of said clearances.

9. An apparatus for preventing flow noise as set forth in claim 7, wherein said means for generating disturbances is comprised of at least one tripping wire extending to the downstream side along the inner wall of said intake passage at the downstream side of said clearances.

10. An apparatus for preventing flow noise, wherein a net is arranged at a portion of a lateral cross-section of an intake passage at a downstream side of a throttle valve near to the same and a plurality of baffle plates extending in a direction parallel to the center axis of said intake passage are arranged at least at part of the remaining portion.

11. An apparatus for preventing flow noise as set forth in claim 10, wherein said net is arranged, in the lateral cross-section of the intake passage, at the half section at the side where the throttle valve pivots to the upstream side when the throttle valve opens and a plurality of baffle plates are arranged at least at part of the remaining half section.

12. An apparatus for preventing flow noise as set forth in claim 10, wherein said plurality of baffle plates are arranged in parallel with each other.

13. An apparatus for preventing flow noise as set forth in claim 10, wherein said plurality of baffle plates are arranged radially with respect to the center axis of said intake passage.

14. An apparatus for preventing flow noise in a throttle valve which provides, in an intake passage of an internal combustion engine at a downstream side directly after a throttle valve provided in said intake passage, means for guiding a flow of intake air able to substantially divide said intake passage into a plurality of portions in cross-section in a manner so that its upstream end is close to said throttle valve and which substantially mutually separates and guides a plurality of flows of intake air with different flow rates and pressures, occurring in said intake passage at the downstream side of said throttle valve due to clearances formed in the initial period when said throttle valve opens, so as to cause the flows to smoothly converge at the downstream end of said guide means and prevent occurrence of disturbances in the flow of intake air, wherein said guide means comprises a partition plate acting as a guide piece, and said partition plate has an arc-shaped shape.

15. An apparatus for preventing flow noise in a throttle valve which provides, in an intake passage of an internal combustion engine at a downstream side directly after a throttle valve provided in said intake passage, means for guiding a flow of intake air able to substantially divide said intake passage into a plurality of portions in cross-section in a manner so that its upstream end is close to said throttle valve and which substantially mutually separates and guides a plurality of flows of intake air with different flow rates and pressures, occurring in said intake passage at the downstream side of said throttle valve due to clearances formed in the initial period when said throttle valve opens, so as to cause the flows to smoothly converge at the downstream end of said guide means and prevent occurrence of disturbances in the flow of intake air, wherein said guide means comprises a partition plate acting as a guide piece, and said partition plate has a flat shape.

16. An apparatus for preventing flow noise in a throttle valve in an air volume regulating mechanism comprising an air passage provided in an internal combustion engine and a throttle valve pivotally supported by a shaft inside said air passage and causing said throttle valve to pivot around said shaft to change the sectional area of said air passage and thereby regulate the volume of air flowing through said air passage, wherein said throttle valve has one peripheral portion which pivots about said shaft to the downstream side in the direction of flow of air in said air passage when the valve opens and another peripheral portion which pivots to the upstream side of said air passage, and wherein a pair of flow barriers for acting on the flows of air passing through the clearances is provided at a downstream side of a pair of clearances formed at portions around said throttle valve most distant from said shaft in the initial period when said throttle valve opens, and wherein the one of said pair of flow barriers arranged at said one peripheral portion of said throttle valve is arranged shifted in position to the downstream side of the air passage from the other of said pair of flow barriers arranged at said other peripheral portion of said throttle valve.

17. An apparatus for preventing flow noise as sent forth in claim 16, wherein said flow barriers each comprise at least one arc-shaped low barrier formed at a downstream side of a said clearance near to said throttle valve to project to the inside from an inner wall of said air passage and substantially extending in the circumferential direction corresponding to said clearance.

18. An apparatus for preventing flow noise as set forth in claim 17, wherein the two ends of a center portion in the circumferential direction of said arc-shaped low barrier are inclined toward the downstream side of said air passage.

19. An apparatus for preventing flow noise as set forth in claim 17, wherein a plurality of said arc-shaped low barriers are provided in parallel.

20. An apparatus for preventing flow noise as set forth in claim 16, wherein said flow barriers each comprise at least one fin formed at a downstream side of a said clearance near to said throttle valve to project to the inside from an inner wall of said air passage and extending from a position corresponding to said clearance to the downstream side along a center axis of said air passage.

21. An apparatus for preventing flow noise as set forth in claim 20, wherein a plurality of said fins are provided in parallel along the center axis of said air passage.

22. An apparatus for preventing flow noise in a throttle valve in an air volume regulating mechanism comprising an air passage provided in an internal combustion engine and a throttle valve pivotally supported by a shaft inside said air passage and causing said throttle valve to pivot around said shaft to change the sectional area of said air passage and thereby regulate the volume of air flowing through said air passage, wherein said throttle valve has one peripheral portion which pivots about said shaft to the downstream side in the direction of flow of air in said air passage when the valve opens and another peripheral portion which pivots to the upstream side of said air passage, and wherein a pair of turbulence generators in the flows of air passing through the clearances is provided at a downstream side of a pair of clearances formed at portions around said throttle valve most distant from said shaft in the initial period when said throttle valve opens, and wherein the one of said pair of turbulence generators arranged at said one peripheral portion of said throttle valve is arranged shifted in position to the downstream side of the air passage from the other of said pair of turbulence generators arranged at said other peripheral portion of said throttle valve.

23. An apparatus for preventing flow noise as set forth in claim 22, wherein each of said turbulence generators comprises at least one dimple formed on the inner wall of said intake passage at the downstream side of said clearances.

24. An apparatus for preventing flow noise as set forth in claim 22, wherein each of said turbulence generators comprises at least one tripping wire extending to the downstream side along the inner wall of said intake passage at the downstream side of said clearances.

25. An apparatus for preventing flow noise in a throttle valve which provides, in an intake passage of an internal combustion engine at a downstream side directly after a throttle valve provided in said intake passage, a flow divider to substantially divide said intake passage into a plurality of portions in cross-section in a manner so that its upstream end is close to said throttle valve and which substantially mutually separates and guides a plurality of flows of intake air with different flow rates and pressures, occurring in said intake passage at the downstream side of said throttle valve due to clearances formed in the initial period when said throttle valve opens, so as to cause the flows to smoothly converge at the downstream end of said guide means and prevent occurrence of disturbances in the flow of intake air, wherein said flow divider comprises a partition plate acting as a guide piece, and said partition plate has an arc-shaped shape.

26. An apparatus for preventing flow noise in a throttle valve which provides, in an intake passage of an internal combustion engine at a downstream side directly after a throttle valve provided in said intake passage, a flow divider to substantially divide said intake passage into a plurality of portions in cross-section in a manner so that its upstream end is close to said throttle valve and which substantially mutually separates and guides a plurality of flows of intake air with different flow rates and pressures, occurring in said intake passage at the downstream side of said throttle valve due to clearances formed in the initial period when said throttle valve opens, so as to cause the flows to smoothly converge at the downstream end of said guide means and prevent occurrence of disturbances in the flow of intake air, wherein said flow divider comprises a partition plate acting as a guide piece, and said partition plate has a flat shape.

* * * * *